US009725860B2

(12) United States Patent
Ng

(10) Patent No.: US 9,725,860 B2
(45) Date of Patent: Aug. 8, 2017

(54) SNOW CLEARING DEVICE

(71) Applicant: Kim Kwee Ng, Centereach, NY (US)

(72) Inventor: Kim Kwee Ng, Centereach, NY (US)

( * ) Notice: Subject to any disclaimer, the term of this patent is extended or adjusted under 35 U.S.C. 154(b) by 214 days.

(21) Appl. No.: 14/591,914

(22) Filed: Jan. 7, 2015

(65) Prior Publication Data

US 2016/0194843 A1 Jul. 7, 2016

Related U.S. Application Data

(60) Provisional application No. 62/092,904, filed on Dec. 17, 2014.

(51) Int. Cl.
*E01H 5/08* (2006.01)

(52) U.S. Cl.
CPC ..... *E01H 5/08* (2013.01)

(58) Field of Classification Search
CPC ..... E01H 5/045; E01H 5/08
USPC ..... 37/244, 248, 260, 261
See application file for complete search history.

(56) References Cited

U.S. PATENT DOCUMENTS 2,085,996 A * 7/1937 Phillips ..... E01H 5/066 37/260
2,847,770 A * 8/1958 Wright ..... E01H 5/04 37/240
4,715,134 A * 12/1987 Schmidt ..... E01H 5/09 37/238
4,858,348 A * 8/1989 Lundy ..... E01H 5/07 37/265
7,975,408 B2 7/2011 Mishra et al.
8,051,587 B2 11/2011 Mills
8,840,353 B2 * 9/2014 Hopkins ..... E01H 1/106 414/338
8,844,172 B2 9/2014 Cmich et al.
8,875,419 B2 * 11/2014 Schmeichel ..... E01H 5/06 37/231
2012/0279093 A1 * 11/2012 Niemela ..... E01H 5/045 37/242
2014/0237863 A1 8/2014 Winter et al.

* cited by examiner

*Primary Examiner* — Joshua Kennedy

(57) ABSTRACT

An array of retractable shields is employed for closing an exposed opening through which the snow enters into a receiver. A piston-like object, which is empowered by a compressed spring and is moving at high speed, makes an impact on the snow with great force. The snow is finally ejected from a chute. The receiver can be lifted higher to clear the snow at a different height from the ground. Alternatively, a snow lifting unit is used to ferry the snow higher for free fall into the receiver for further processing. Belt and chain driven devices employing a plurality of collector elements are employed. An impact force produced by a rapid flow of compressed air also forces the snow out from a confined enclosure.

20 Claims, 8 Drawing Sheets

SNOW CLEARING DEVICE

CROSS-REFERENCE TO RELATED APPLICATIONS

This application claims the benefit of provisional patent application No. 62/092,904 titled "Snow clearing device", filed on Dec. 17, 2014, all of which are hereby incorporated by reference in its entirety.

FIELD OF THE INVENTION

A snow removal device for removing snow from the ground and the like.

BACKGROUND OF THE INVENTION

There are many prior art devices that use sophisticated and heavy machines to remove the snow from the ground. For example, a U.S. patent, with Ser. No. 8,844,172, has described a three-stage snow thrower which uses an impeller to throw the snow through a chute.

A U.S. Patent Application No., 2014/0237863, describes a snowblower assembly for removing snow from a paved surface by using a pair of rotating side augers and a rotating impeller.

The snow thrower typically uses rotating augers to move the snow toward an impeller. The impeller are shaped and configured such that when it is rotated, the snow is subject to the centrifugal force. The snow is moved by the centrifugal force and discharged into a chute. The removal of the snow in this case is a non-impact operation.

It is desirable to use a method to generate an impact force, and provides an apparatus which is cost effective and efficient to operate in the removal of the snow from the surface, such as pavement, side walks and the like.

BRIEF SUMMARY OF THE INVENTION

The present invention provides a more cost effective and attractive snow clearing device for removing the snow from the ground. The apparatus also offers excellent energy efficiency in the operation of the snow clearing device.

In a first embodiment of the invention, a pivotable flap and a retractable outer shield are used to close an exposed opening through which the snow enters into a receiver. A piston-like object, sitting in a confined enclosure which is made possible by the retractable shield, would move at a high speed to impact the snow, when a compressed helical spring connecting to the piston-like object is allowed to be released and returned to its normal un-compressed state. The snow is subsequently ejected from a chute. The receiver can be raised from the ground to clear the snow at different height.

The piston-like object is pulled by a motor means via a flexible string. The motor means is substituted by a hand-driven roller in a second embodiment of the invention. An assembly for closing or opening the entrance to the receiver is described.

Instead of lifting the receiver, a snow lifting unit is employed. A spade-shaped collector element is raised and tilted toward the receiver. A multi-platforms device using a second spade-shaped collector element is also described.

An array of containers mounted on a pair of rotating endless chains is used to ferry the snow higher above the ground. Likewise, a rotating continuous belt carrying an array of spade-shaped collector elements is described.

Compressed air can be used to substitute the helical spring to force the snow out from the chute. A manually lifting unit to move the receiver up from the ground is employed in the invention.

Figure 1:
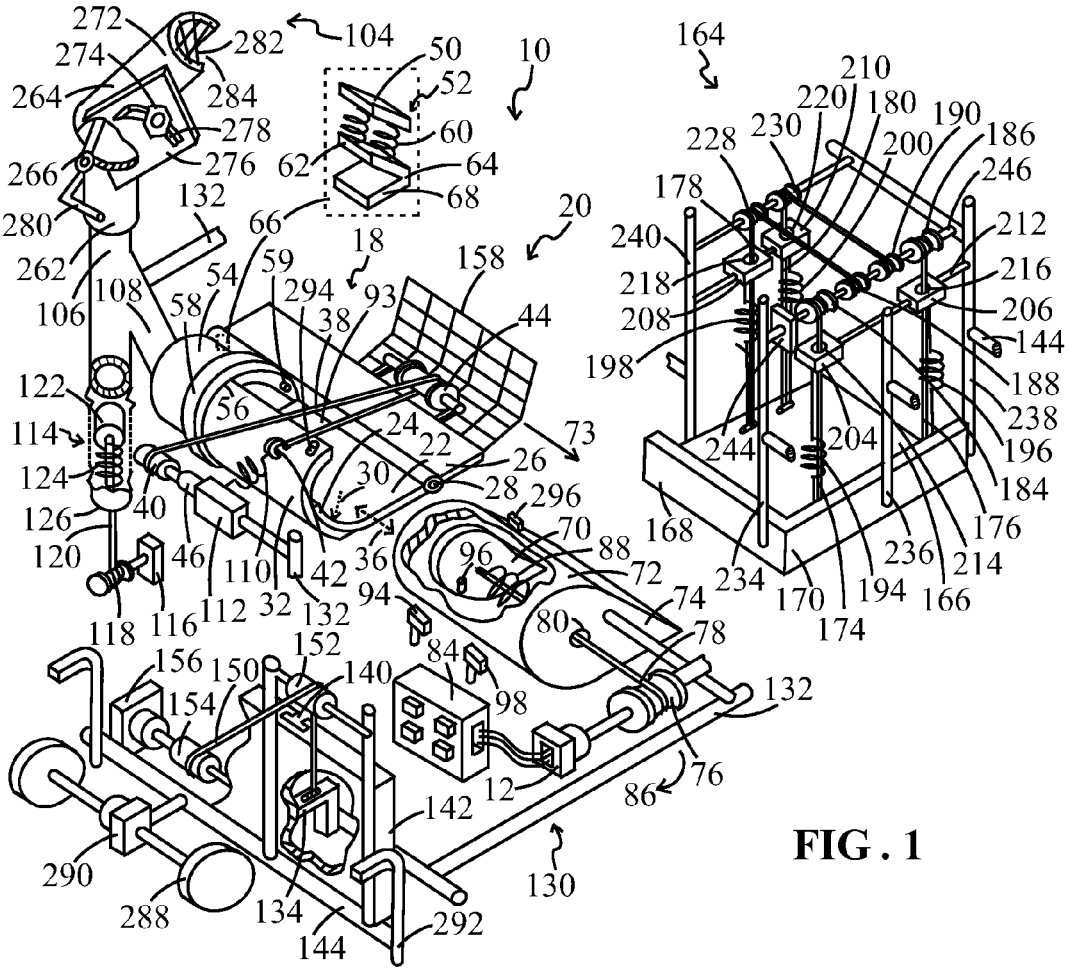
FIG. 1 is a simplified diagram of a first preferred embodiment using a plurality of rotatable shields for confining the snow.

It should be noted that all the drawings are diagrammatic and not drawn to scale. Relative dimensions and proportions of parts of these figures have been shown exaggerated or reduced in size for the sake of clarity and convenience in the drawings. Accordingly, the drawings and description are to be regarded as illustrative in nature and not as restrictive.

DETAILED DESCRIPTION OF THE INVENTION

A better and more complete understanding of the practice of the invention is provided by the following description and reference to the accompanying drawings, wherein like symbols refer to like elements of the invention.

In a first preferred embodiment of the invention shown in FIG. 1, a snow clearing device 10 adapted for use with an engine, or the like as a power drive means 12 for clearing snow comprises a collector element 18, which serves as a receiver 20 for receiving the snow. The receiver 20 comprises an elongated band, or a receiving strip 22, an elongated curved inner sheet 24 which is fixedly mounted along a first longitudinal edge of the receiving strip 22, and a pivotable flap 26 pivotable on a hinge 28. The hinge 28 is mounted along a second longitudinal edge of the receiving strip 22.

The circumference of the curved inner sheet 24 is usually slightly more than a quarter of a circle of radius r 30 which is shown as a dashed line in FIG. 1. A curved outer shield 32 having an inner radius r 30, is made by keeping slightly more than one-half of a hollow cylinder along the cylindrical axis 36. The outer shield 32 is rotatable around the curved inner sheet 24. When the receiver 20 is lowered to the ground and the snow clearing device 10 is moved forward, the receiving strip 22 and the pivotable flap 26 of the receiver 20 are filled with snow.

A flexible string 38 is connected between a roller 40 and a hook 42 which is mounted on the surface of the outer shield 32. The flexible string 38 passes over a relay roller 44 which is mounted on a longitudinal outer edge of the pivotable flap 26. When the string 38 is pulled by a motor means 46, the pivotable flap 26 swings upwardly until it is stopped by a spring board 50 of a spring assembly 52 which is mounted on a hollow enclosure 54. The hollow enclosure 54, which has a shape to be described below, is a housing enclosure extended from a first end of the curved inner sheet 24 along the cylindrical axis 36.

The motor means 46 continues to rotate and pulls the outer shield 32 so that the rim 56 of the outer shield 32 slides along a ring 58 which is mounted on the hollow enclosure 54. The outer shield 32 finally stops rotating when it encounters a barrier 59 mounted on the hollow enclosure 54. It is noted that the outer shield 32 would not have dislodged from the hollow enclosure 54, if the circumference of the outer shield 32 is more than one-half of the circumference in the circular portion of the hollow enclosure 54. Alternatively, the rim 56 of the outer shield 32 is slidable in a groove (not shown) embedded in a side of the ring 58. Another ring 58 (not shown) mounted on the housing 72 is similarly configured so that the outer shield 32 is rotatable between the two rings 58.

An array of springs 60 is positioned between the spring board 50 and a first metal bar 62 of an angled bracket 64 as shown in the dashed box 66. A second metal bar 68 of the angled bracket 64 is joint to the first metal bar 62 at an angle at their shared terminal ends. The second metal bar 68 is mounted on the hollow enclosure 54 by bolts and nuts (not shown).

Figure 2:
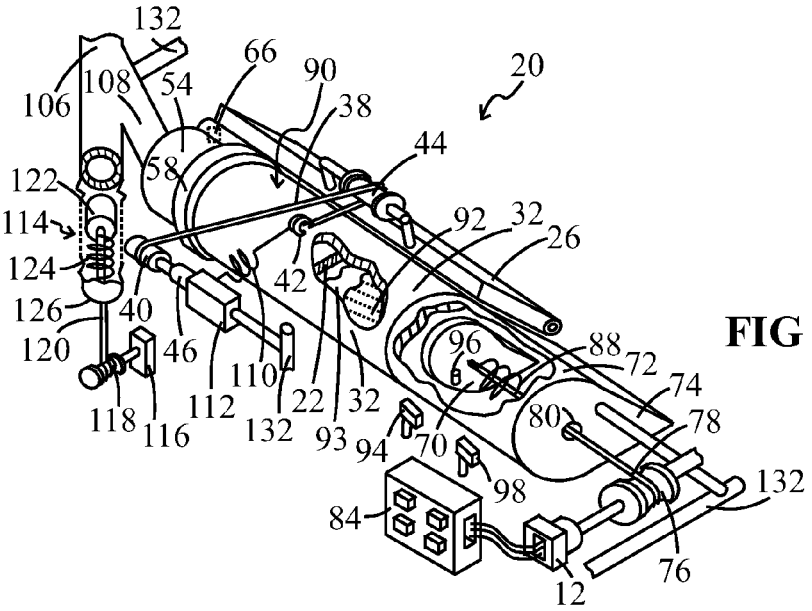
FIG. 2 is a portion of the structure of the first preferred embodiment showing the closing of the exposed opening in the receiver before the ejection of the snow.

The hollow enclosure 54 has a shape similar to an odd-shaped piston-like object 70, so that the piston-like object 70 can move freely inside the hollow enclosure 54. The dimension of the sides in a cross-sectional view of the piston-like object 70 is the linear combination of a flat side of the receiving strip 22 where the piston-like object 70 is resting as shown in FIG. 1, the curved rim of the curved inner sheet 24, the rim of the outer shield 32 and a flat side of the pivotable flap 26 when the outer shield 32 and the pivotable flap 26 are moved to a closed position as shown in FIG. 2.

A second end of the curved inner sheet 24 is similarly extended to provide a housing 72 in which the piston-like object 70 is allowed to move. The piston-like object 70, which is a slidable object in the housing 72, is used as an impacting means for impacting the snow with great force.

As shown in FIG. 1, the second end of the curved inner sheet 24, which is drawn to be separated from the housing 72 in order to show their structures, is connected to the housing 72 when the curved inner sheet 24 is moved along the line 73 to join the housing 72.

The bottom end of the housing 72 is terminated by a bottom cover 74. The piston-like object 70 and a roller 76 are connected by a flexible string 78 which runs through an opening 80 in the bottom cover 74 of the housing 72. The power drive means 12, which is controlled via a stored program device means 84, rotates the roller 76 in a clockwise directional arrow 86 to pull the piston-like object 70 via the string 78 toward the bottom cover 74.

An elastic coil or a helical spring 88, which is placed between the piston-like object 70 and the bottom cover 74, is compressed by the piston-like object 70 moving toward the bottom cover 74. The potential energy generated from the movement of the piston-like object 70 is subsequently stored in the spring 88.

The spring 88 in a compressed mode is said to be in an energized state and it can be used as an energizer means. The energizer means is ready to push the piston-like object 70 away. The energy is delivered to the piston-like object 70 when the spring 88 is allowed to be released and returned to its normal uncompressed state.

A confined enclosure 90, as shown in FIG. 2, is formed when the snow 92, denoted by the dashed lines and residing on the receiving strip 22 of the receiver 20, is confined by a plurality of movable shields. In this case, the movable shields are the outer shield 32 and the pivotable flap 26, they are serving as a shutter means to cover the gap or the exposed opening 93 above the receiving strip 22 of the receiver 20. The entrance through which the snow enters into the receiver 20 is closed by the movable shields. In other words, a retractable cover is employed to close the entrance.

The outer shield 32 and the pivotable flap 26 are rotated to their positions shown in FIG. 2 by the flexible string 38 pulled by the roller 40 which is rotated by the motor means 46, thereby closing the exposed opening 93 above the receiving strip 22. At the same time, the snow 92 is pushed inwardly to fill the interior of the curved inner sheet 24 by the upward swinging motion of the pivotable flap 26.

When a first sensor 94 mounted at a first position near the housing 72 detects the presence of a magnet 96 mounted on the piston-like object 70, the outer shield 32 is opened to receive the snow, as shown in FIG. 1. After the piston-like object 70 has moved further toward the bottom cover 74 to a second position which is detected by a second sensor 98, the stored program device means 84 issues a command to motor means 46 to close the exposed opening 93 in the receiver 20.

The motor means 46 rotates the roller 40 to pull the string 38. The string 38 pulls the pivotable flap 26 upward. The outer shield 32 is also rotated and it moves along the ring 58 mounted on the enclosure 54. The exposed opening 93 above the receiving strip 22 is closed by the outer shield 32, as shown in FIG. 2.

After a brief pause, with the time interval having been previously set by a user in the stored program device means 84, the piston-like object 70 is released when the electric current flowing to the motor means 12 is turned off. The spring 88, having been compressed by the piston-like object 70 which has moved toward the lower bottom cover 74 of the housing 72, expands quickly and pushes the piston-like object 70 away at high speed.

Clearly, the piston-like object 70 in this case is empowered by the spring 88 to move the snow 92 away. The spring 88 is said to be producing an impact force which is deliverable to the piston-like object 70. The snow 92 inside the receiver 20 of FIG. 2 is impacted by the piston-like object 70. The resulting impact sends the snow 92 moving through the rest of the enclosure 54. The snow 92 finally exits from a chute 104 and is relocated elsewhere, after running through a passageway formed by a vertical pipe 106 and an inclined pipe 108 of FIG. 1.

After another pause, the stored program device means 84 issues a command to allow the motor means 12 to rotate the roller 76 in the clockwise directional arrow 86. The piston-like object 70 is moved by the string 78 toward the lower bottom cover 74 of the housing 72.

When the piston-like object 70 reaches a position detected by the sensor 94, the electric current flowing to the motor means 46 is stopped. As the compressed springs 60 expands, the spring board 50 pushes the pivotable flap 26 away and the pivotable flap 26 falls toward the ground.

A spring 110 is positioned between the hook 42 and a support board 112. The spring 110, having been previously expanded when the outer shield 32 is rotated to closed the exposed opening 93, is contracted and pulls the outer shield 32 along the ring 58 to expose the opening 93 above the receiving strip 22 of the receiver 20. When the piston-like object 70 is moved to reach a position detected by the sensor 98, a new cycle in the ejection of the snow would be ready to start again.

A secondary ejecting means 114 is provided if the spring 88 does not provide enough force to strike or propel the snow upward and away from the snow clearing device 10. A motor means 116 rotates a roller 118 which pulls a flexible string 120 downward. The string 120 which is connected between the roller 118 and a piston 122, wraps around the roller 118. A spring 124 which is sitting between the piston 122 and the bottom closed-end 126 of the vertical pipe 106 is compressed.

When a command from the stored program device means 84 is issued to stop the electric current flowing to the motor means 116, the spring 124 expands and pushes the piston 122 upwardly. The snow sitting on top of the piston 122 is impacted with great force and is ejected from the chute 104.

If the snow is soft and the snow accumulation is small on the ground, the snow above the outer shield 32 would typically collapse into the receiving strip 22, when the outer shield 32 is retracted to expose the opening 93 above the receiving strip 22. This happens when the snow 92 in the confined enclosure 90 of FIG. 2 has already been ejected. Alternatively, the receiver 20 can be lifted higher above the ground as explained below.

An operating assembly 130 comprising the receiver 20, the motor means 12 and their associated structures described above is supported by a plurality of inter-connecting support beams 132. An array of protruding T-shaped heads (not shown) is mounted on an array of support bars 134 of the support beams 132. The T-shaped heads, not shown, is slidable upwardly along an array of T-shaped inner tracks 140 embedded in a support board 142 mounted to a body frame 144.

A belt or a flexible string 150 which runs over a relay roller 152 is connected to one of the support bars 134 and a roller 154. The roller 154 is rotated by a motor means 156 for controlling the height of the operating assembly 130 by pulling or releasing the string 150. The operating assembly 130 can be raised to a different height from the ground to clear the snow. The snow can be successively removed one layer at a time at different height from the ground.

To block small tree branches from reaching the receiver 20, a filtering barrier 158, with support means (not shown), is detachably attached to the outer edge of the pivotable flap 26. For example, a curved or angled wired mesh of appropriate size and openings can be used as the filtering barrier 158. Alternatively, the filtering barrier 158 can be mounted near the hinge 28. It is noted that the filtering barrier 158 is not shown in FIGS. 2, 3 and 10, so that all other system components would not be obscured by the presence of the filtering barrier 158.

To reduce the resistance faced by the housing 72 in the forward motion of the snow clearing device 10, an auxiliary snow ferrying and lifting unit 164 is employed. The snow lifting unit 164 comprises a spade-shaped collector element 166 having two walls 168, 170 mounted on the adjacent sides of the spade-shaped collector element 166. The spade-shaped collector element 166 is lifted by an array of flexible strings 174, 176, 178, 180 which connect respectively from two opposite sides of the spade-shaped collector element 166 to an array of rollers 184, 186, 188, 190 placed above the spade-shaped collector element 166.

An array of springs 194, 196, 198, 200 is mounted between the spade-shaped collector element 166 and an array of base boards 204, 206, 208, 210. The base boards 204, 206, 208, 210 are mounted on an array of interconnecting support beams 212. Each of the base boards 204, 206, 208, 210 has a through opening 214, 216, 218, 220 through which each of the strings 174, 176, 178, 180 passes respectively. The strings 178, 180 pass respectively over an array of relay rollers 228, 230 before connecting to their respective rollers 188, 190.

The spade-shaped collector element 166 is movable within an array of support beams 234, 236, 238, 240 which are mounted to the body frame 144. The interconnecting support beams 212 are connected to the body frame 144.

An instruction from the stored program device means 84 is issued to a motor means 244 to rotate the rollers 184, 186, 188, 190 which are mounted on the same axle 246. The diameters of the rollers 184, 186 are chosen to be bigger than the diameters of the rollers 188, 190, so that the spade-shaped collector element 166 is tilted at an angle to allow the snow residing on the spade-shaped collector element 166 to fall to the ground, when the spade-shaped collector element 166 is lifted upwardly by the rotating rollers 184, 186, 188, 190.

For a single turn in the rotation of the rollers 184, 186, the lengths of the strings 174, 176 wound around the rollers 184, 186 respectively are more than the lengths of the strings 178, 180 wound around their respective rollers 188, 190.

When an instruction is given from the stored program device means 84 to the motor means 244 to release the strings 174, 176, 178, 180 by turning off the motor means 244, the spade-shaped collector element 166 is urged by the springs 194, 196, 198, 200 to move downwardly. The spade-shaped collector element 166 returns to the ground. The motor means 244 is mounted on the support beams 234.

The chute 104 comprises a vertical hollow pipe 262 and a pivotable curved flap 264 pivoting on a hinge 266 which is mounted on the vertical pipe 262. The upper end 272 of the flap 264 is fastened by a fastener 274 to a support plate 276. The inclined angle of the flap 264 can be adjusted by moving the fastener 274 along a curved slot 278 in the plate 276. A chute handle 280 is mounted to the vertical pipe 262 so that the vertical pipe 262 can be rotated with respect to the vertical pipe 106.

A wired mesh 282 is mounted to an outlet 284 of the chute 104 to limit the size of the solid material which may exit from the chute 104. A container pan, not shown, may be placed below the outlet 284. The device 10 is provided with a set of wheels 288 driven by a motor means 290 and a set of handles 292. As an added safety measure, a magnet 294 is mounted at a corner of the outer shield 32. A sensor 296 mounted on the housing 72 sends a signal to the stored program device means 84, when the outer shield 32 has rotated to close the exposed opening 93 properly before the ejection of the snow 92.

Figure 3:
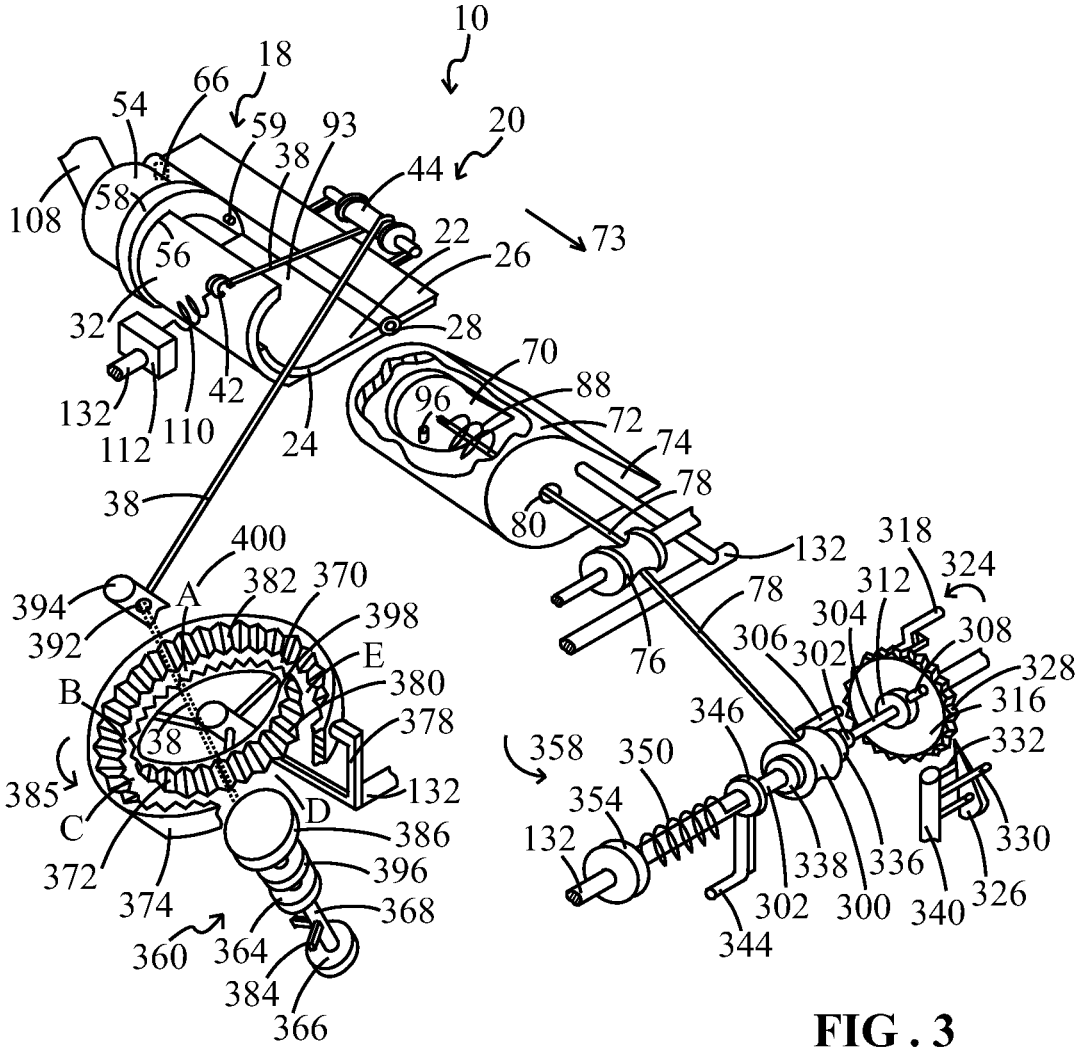
FIG. 3 is a simplified diagram of a second preferred embodiment of the invention using a manually driven roller to compress a helical spring.

A second embodiment of the invention is shown in FIG. 3, where a hand-driven roller 300 is used as a drive means to move a string 78 to cause a spring 88 to be deformed. The structure of the receiver 20 of FIG. 1 is applicable in this embodiment.

The spring 88 in a deformed state would convey or transfer an impacting energy deliverable to a piston-like object 70, when the spring 88 is allowed to return to its normal state. The compression of the spring 88 and the operation to close the exposed opening 93 above a receiving strip 22 are described below.

The string 78 which is attached to the piston-like object 70 is connected to the roller 300. The roller 300 is freely rotatable about a hollow pipe 302 which is movable along an axle 304. A protruding stub 306 is fixedly mounted on a side of the roller 300. The protruding stub 306 engages a stub 308 protruding from a cylinder 312 fixedly attached to a cog wheel 316.

The cog wheel 316 is rotated manually by turning a handle 318 mounted on a side of the cog wheel 316. The handle 318 is rotated in a clockwise directional arrow 324, as a pivotable pin 326 which is placed against the gear track 328 of the cog wheel 316 can be pivoted within a small swinging angle of rotation. The angle of rotation is limited by two barriers 330, 332 which are mounted on a support 340 and placed near the cog wheel 316.

The barriers 330, 332 allows the cog wheel 316 to rotate in one direction of the rotational motion. The configuration described above is equivalent to ratchet and pawl gears known in the art. The cog wheel 316, the pivotable pin 326 and the barriers 330, 332 can be replaced by the ratchet and pawl gears. When the handle 318 is turned, the roller 300 is rotated to pull the piston-like object 70 via the string 78 toward the bottom cover 74 of the housing 72. The roller 300 is positioned between two rings 336, 338 which are mounted on the hollow pipe 302.

A handle 344 is attached to a disk 346 which is mounted on the hollow pipe 302. The handle 344 is used to move the roller 300 along the axle 304. When the handle 344 pulls the roller 300 away from the cog wheel 316, the stubs 306, 308 are disengaged. The roller 300 is now free to rotate, it releases the string 78, the spring 88 is expanded and pushes the piston-like object 70 away from the bottom cover 74 of the housing 72.

A spring 350 which is positioned between a disk 354 and the disk 346 is compressed during the above disengaging operation of the stubs 306, 308. When the handle 344 is released, the compressed spring 350 urges the handle 344 to move toward the cog wheel 316, allowing the protruding stub 306 to be engaged with the stub 308 on the cylinder 312.

In the drawing, the manually driven roller 300 is shown to have rotated by 90°, 358, from the actual intended operation of the device 10, so that the structure for driving the roller 300 can clearly be seen. In the following, a movable assembly 360 is scaled up disproportionally to produce a better picture in the structure of the movable assembly 360.

The movable assembly 360 comprises two disks 364, 366 which are attached to an axle 368. The disks 364, 366 are separated so that the disks 364, 366 slide in the path 370 formed by an inner hollow cylinder 372 and an outer hollow cylinder 374, with the disk 364 touching the upper surfaces of the cylinders 372, 374, and the disk 366 oriented below the lower surfaces of the cylinders 372, 374.

The cylinders 372, 374 are attached to a support 378 connected to the support beams 132. An array of gear tracks 380 is mounted on the external surface of the inner hollow cylinder 372. Another array of gear tracks 382 is mounted on the inner surface of the outer hollow cylinder 374.

A pair of flexible strips 384 are mounted at an angle on the axle 368 of the movable assembly 360 between the disks 364, 366, so that the movable assembly 360 slides between the gear tracks 380, 382 in a counter-clockwise directional arrow 385. A knob 386 is provided to move the movable assembly 360 between the tracks 380 and 382.

A string 38 must pull the pivotable flap 26 up and rotates the outer shield 32 by a total of extra length l, so that the exposed opening 93 above the receiving strip 22 of the receiver 20 is closed. The string 38, which is threaded through an opening 392 in a support beam 394, is connected between the hook 42 and a rotatable washer 396. The rotatable washer 396 is positioned between the knob 386 and the disk 364. A portion of the string 38 between the opening 392 and the rotatable washer 396 is denoted by a pair of dashed lines.

The inner cylinder 372 is formed by two hollow cylinders of different radii. The first cylinder is a one-half part of a hollow tube 398 having an inner radius l with a center A, 400, as the origin of the semi-circle in the cross-sectional view of the hollow tube 398. The second cylinder is a portion of a hollow tube having a much bigger inner radius than the radius l of the hollow tube 398.

The outer cylinder 374, which has a similar shape as the inner cylinder 372, is bigger than the inner cylinder 372. The path 370 is formed between the two hollow cylinders 372, 274 to allow the assembly 360 to move along the path 370 between them.

When the assembly 360 is placed at a position along a path CDE in FIG. 3, the string 38 has stretched to its maximum limit with the extra length l of the string 38 fully extended. The extra length l is measured from the point A, 400, to any position along the path CDE, the pivotable flap 26 and the outer shield 32 in this case are pulled to close the exposed opening 93 above the receiving strip 22 of the receiver 20.

When the assembly 360 is moved to a position along a path EAB in FIG. 3, the string 38 is relaxed, the pivotable flap 26 is returned to the ground, and the outer shield 32 is pulled back by the contraction of the spring 110.

To operate the snow clearing device 10 successfully, the handle 318 is rotated in the clockwise directional arrow 324, so that the string 78 is wound around the roller 300. The piston-like object 70 is moved toward the bottom cover 74 of the housing 72. The assembly 360 is then moved from the point C to the positions marked by D, E, A, B and C in sequence in FIG. 3.

During the movement of the assembly 360 in the above sequences, the following events occur. The exposed opening 93 is initially closed along the path CDE. At any point along the path EAB, the opening 93 is exposed to receive the snow, as the pivotable flap 26 returns to the ground and the outer shield 32 is pulled back as shown in FIG. 3. In the final phase, the opening 93 is finally closed, when the assembly 360 is placed at the position C.

The handle 344 is then pulled so that the roller 300 is moved away from the cog wheel 316. The protruding stub 306 is disengaged from the stub 308, the roller 300 is free to rotate. The string 78 is released, and the spring 88 is expanded to push the piston-like object 70 against the snow. The snow is ejected at high speed, and finally exited from the chute 104 of FIG. 1.

Figure 4:
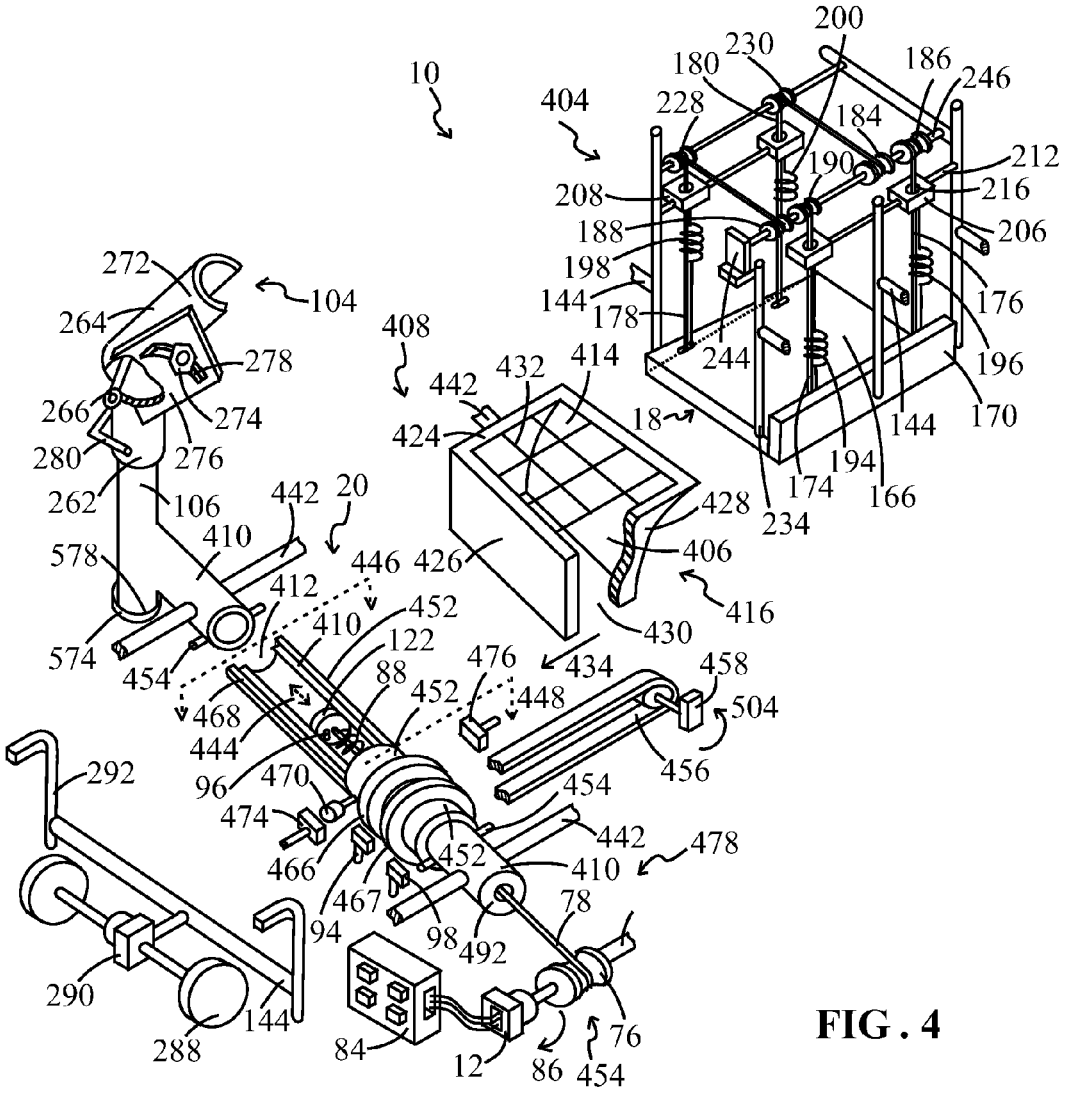
FIG. 4 is a simplified diagram of a third preferred embodiment using a snow-lifting unit.

In a third preferred embodiment of the invention shown in FIG. 4, a snow clearing device 10 adapted for use with a power drive means 12 for a collector means lifted by a snow lifting unit 404, comprises a spade-shaped collector element 166.

The snow lifting unit 404 is similar to the snow lifting unit 164 of FIG. 1, except that the wall 168 is not employed and the positions of the two rollers 184 and 190 have been swapped. The snow sitting on the spade-shaped collector element 166 of FIG. 4 would be tilted and slid into an opening 406 of a diverting and processing unit 408, when a motor means 244 rotates an array of rollers 190, 188, 184, 186 and moves the spade-shaped collector element 166 upward along a vertical circuit.

A receiver 20 for receiving the snow is provided for catching and retaining the snow gravitating from the spade-shaped collector element 166 at an elevated locus of the vertical circuit. The receiver 20 in this case comprises a hollow inclined pipe 410 having an opening 412 as shown in FIG. 4.

The snow coming from the spade-shaped collector element 166 is directed to fall into the opening 412 of the hollow pipe 410 by sliding down a curved wall 414 of a diverting enclosure 416 in the diverting and processing unit 408 through the opening 406 of the diverting enclosure 416. The diverting enclosure 416 is formed by an array of walls 414, 424, 426, 428, having a lower through opening 430 at the bottom end of the diverting enclosure 416. The upper opening 406 is oriented into a position for receiving the snow falling from the spade-shaped collector element 166.

A filtering barrier 432, e.g. a wired mesh, is attached to the upper part of the diverting enclosure 416, so that small tree branches and the like would not enter the receiver 20 through the opening 406 of the diverting enclosure 416.

The lower through opening 430 matches the opening 412 of the inclined pipe 410 when the diverting enclosure 416 is moved along a line 434 as shown in FIG. 4. The diverting enclosure 416 and the inclined pipe 410 are separately drawn in FIG. 4 so that their structures can clearly be seen and understood.

A distal open end of the inclined pipe 410 is connected to a rotatable chute 104 via a hollow vertical pipe 106. The diverting enclosure 416, the inclined pipe 410 and the vertical pipe 106 are supported by an array of support beams 442 fixedly attached to a body frame means 144.

The upper portion of the inclined pipe 410 is drawn separately from the rest of the inclined pipe 410 to show its internal structure along a line 446. A portion of the inclined pipe 410 is cut away by one-half along the cylindrical axis 444 from the line 446 to another line 448 to provide the opening 412 for receiving the snow fallen from the spade-shaped collector element 166.

Figure 5:
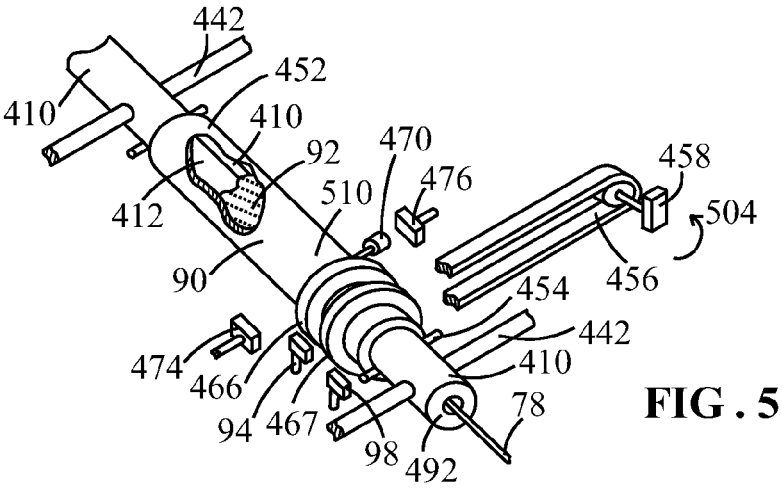
FIG. 5 is a simplified diagram showing the snow being confined by an outer rotatable cylinder.

A rotatable outer hollow cylinder 452 is used in combination with the inclined pipe 410 to constitute a confined enclosure 90 as shown in FIG. 5. The outer hollow cylinder 452 is rotatable around the inclined pipe 410. The outer hollow cylinder 452 is constraint to move between an array of protruding stubs 454 mounted on the exterior surface of the inclined pipe 410.

The outer cylinder 452 is rotated by a belt 456 driven by a motor means 458. The belt 456 is wrapped around the outer cylinder 452 and the belt 456 is constraint to move between two outer rings 466 and 467, which are mounted spaced-apart on the outer cylinder 452 to provide a path for the rotating belt 456.

A portion of the outer cylinder 452 is similarly cut away by slightly less than one-half along the cylindrical axis 444 to provide an opening 468. The snow falls through the opening 468 and the opening 412 of the inclined pipe 410 into the interior of the inclined pipe 410, when the outer cylinder 452 is rotated to align its opening 468 with the the opening 412 of the inclined pipe 410. Mounted onto the exterior surface of the outer cylinder 452 is a small magnet 470, which is used with an array of magnetic sensors 474, 476 to provide angular orientation of the outer cylinder 452 through to a stored program device means 84 for further analysis and controls.

A thrust-generating unit 478 comprises the motor means 12, a spring 88 and a piston 122. The piston 122, which is a cylinder movable in the inclined pipe 410, has the same functionality as the piston-like object 70 described in the previous sections. The piston 122 is an impacting means to impact the snow with great force to force the snow to move.

The motor means 12 rotates a roller 76 which pulls a flexible string 78. The string 78 is connected between the roller 76 and the piston 122. The rotation of the roller 76 in a clockwise directional arrow 86 would pull the piston 122 toward the lower terminal end 492 of the inclined pipe 410, thus compressing the spring 88 which is positioned between the piston 122 and the lower terminal end 492 of the inclined pipe 410.

Mounted on the piston 122 is a small magnet 96 which is used with an array of magnetic sensors 94, 98 to provide positional information of the piston 122 to the stored program device means 84, The stored program device means 84 receives sensor signals from the sensors 474, 476, 94, 98 and controls the operations of the diverting and processing unit 408. When the piston 122 moves past a first position where the sensor 94 is located, as the motor means 12 continues to rotate the roller 76 in the clockwise directional arrow 86, the stored program means 84 issues a command to the motor means 458 to rotate the outer hollow cylinder 452 in the counter-clockwise directional arrow 504.

The outer hollow cylinder 452 is rotated until the opening 412 of the inclined pipe 410 is exposed and ready to receive the snow falling through the diverting enclosure 416. As shown in FIG. 4, this happens when the magnet 470 has rotated to a side of the inclined pipe 410 and the sensor 474 has detected the presence of the magnet 470. The stored program device means 84 stops the motor means 458 from turning further after receiving the signal from the sensor 474.

As the piston 122 continues to move toward the lower terminal end 492 of the inclined pipe 410, it reaches a second position and the presence of the magnet 96 is detected by the sensor 98, a command from the stored program device means 84 is issued to allow the motor means 458 to rotate the outer hollow cylinder 452 by an angle of 180°.

In this case, the magnet 470 is rotated to the other side of the inclined pipe 410, the sensor 476 has detected the presence of the magnet 470 as shown in FIG. 5. The stored program device means 84 stops the motor means 458 from turning further after receiving the signal from the sensor 476.

As shown in FIG. 5, the opening 412 of the inclined pipe 410 is closed by the outer surface 510 of the outer hollow cylinder 452. The snow 92, which is denoted by the dashed lines and partially filled in the inclined pipe 410, is confined by the lower portion of the inclined pipe 410 and the upper portion of the outer hollow cylinder 452.

Thus, a confined enclosure in this arrangement is an operating-room enclosure made possible by rotating a rotatable and retractable curved door. In this case, the outer hollow cylinder 452 is used as a movable door to close the opening 412 of the inclined pipe 410.

When the motor means 458 of FIG. 4 has stopped, the stored program device means 84 issues another command to release the string 78 by turning off the electric current flowing to the motor means 12. The spring 88, having been compressed by the piston 122 which has been moving toward the lower terminal end 492 of the inclined pipe 410, expands quickly and pushes the piston 122 away at high speed.

The snow 92 inside the inclined pipe 410 is impacted by the piston 122 which is moving at high velocity. The resulting impact sends the snow 92 moving through the rest of the inclined pipe 410. The snow 92 finally exits from the chute 104, after running through the vertical pipe 106.

After a brief pause, which is set by the user and stored in the stored program device means 84, the stored program device means 84 issues a command to allow the motor means 12 to rotate the roller 76 in the clockwise directional arrow 86. The piston 122 is moved by the string 78 toward the lower terminal end 492 of the inclined pipe 410. When the piston 122 reaches the first position and is detected by the sensor 94, a new cycle in the ejection of the snow would be ready to start again.

A detachable mesh-like cover 574 is mounted at the bottom 578 of the vertical pipe 106 to provide a temporary storage area for small debris gravitating in the vertical pipe 106 when the snow 92 is moving upwardly in the vertical pipe 106. The motor means 458 and the sensors 474, 476, 94, 98 are mounted on the support beams 442.

Figure 6:
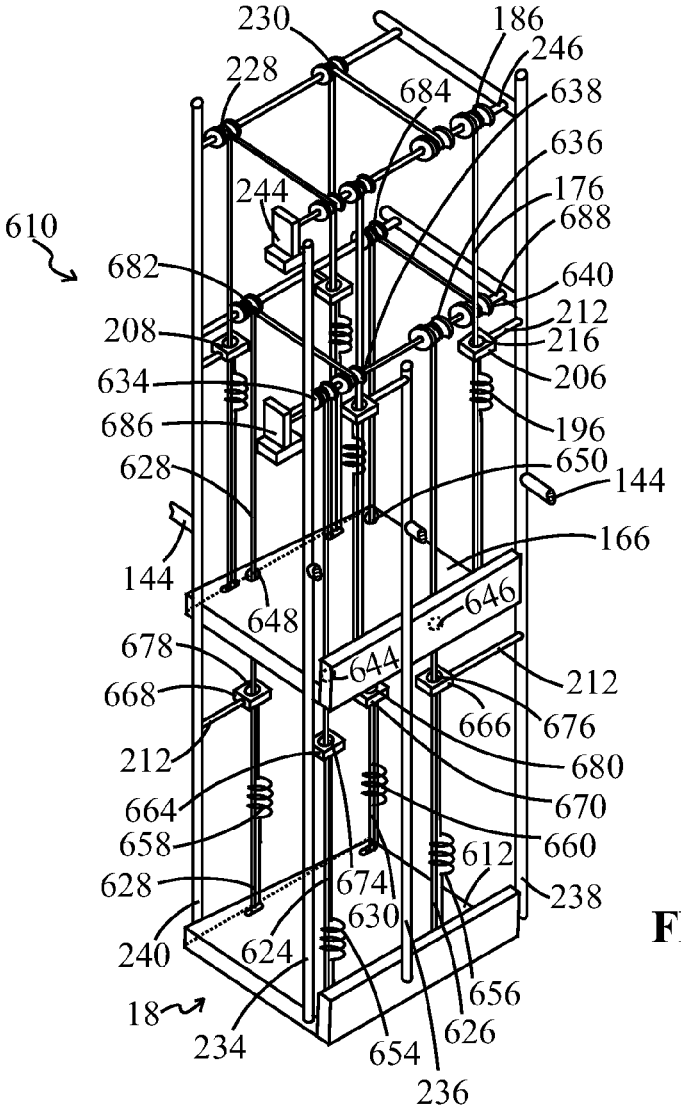
FIG. 6 is a simplified diagram of a part of the fourth preferred embodiment using a multi-platform snow-lifting unit.

In FIG. 6, a portion of a fourth preferred embodiment of the invention is shown. A multi-platforms snow lifting unit 610 is used to lift a plurality of collector elements 18. All other components and operation of the snow clearing device 10 described in the third embodiment of the invention are applicable in this section.

As shown in FIG. 6, the multi-platforms snow lifting unit 610 comprises a second spade-shaped collector element 612 in addition to the first spade-shaped collector element 166 used in FIG. 4. The structure and the operation of the multi-platforms snow lifting unit 610 are similar to the single-layer snow lifting unit 404 of FIG. 4.

The second spade-shaped collector element 612 is lifted by an array of flexible strings 624, 626, 628, 630 which connect respectively between two opposite sides of the spade-shaped collector element 612 and an array of rollers 634, 636, 638, 640 placed above the spade-shaped collector element 166. The strings 624, 626, 628, 630 pass through respectively an array of through openings 644, 646, 648, 650 in the spade-shaped collector element 166 before connecting to their respective rollers.

An array of springs 654, 656, 658, 660 is mounted between the spade-shaped collector element 612 and an array of their corresponding base boards 664, 666, 668, 670. The base boards 664, 666, 668, 670 are mounted to an array of interconnecting support beams 212. The base board 670 is supposed to be hidden below the spade-shaped collector element 166, however, it is relocated to show its structure in the drawing.

Each of the base boards 664, 666, 668, 670 has a through opening 674, 676, 678, 680 through which each of the strings 624, 626, 628, 630 passes respectively. The strings 628, 630 pass over an array of relay rollers 682, 684 before connecting to their respective rollers 638, 640. The spade-shaped collector element 612 is movable within an array of support beams 234, 236, 238, 240 which are mounted to the body frame 144.

An instruction from the stored program device means 84 is issued to a motor means 686 to rotate the rollers 634, 636, 638, 640 which are mounted on the same axle 688. The diameters of the rollers 636, 640 are chosen to be bigger than the diameters of the rollers 634, 638, so that the spade-shaped collector element 612 is tilted at an angle to allow the snow residing on the spade-shaped collector element 612 to fall into the opening 406 of the diverting and processing unit 408 of FIG. 4, when the spade-shaped collector element 612 is lifted upwardly by the rotating rollers 634, 636, 638, 640.

For a single turn in the rotation of the rollers 636, 640, the lengths of the strings 626, 630 wound around the rollers 636, 640 respectively are more than the lengths of the strings 624, 628 wound around their respective rollers 634, 638.

When an instruction is given from the stored program device means 84 to the motor means 686 to release the strings 624, 626, 628, 630, the spade-shaped collector element 612 is urged by the springs 654, 656, 658, 660 to move downwardly. The spade-shaped collector element 612 returns to the ground. The motor means 686 is mounted on the support beams 234.

Figure 7:
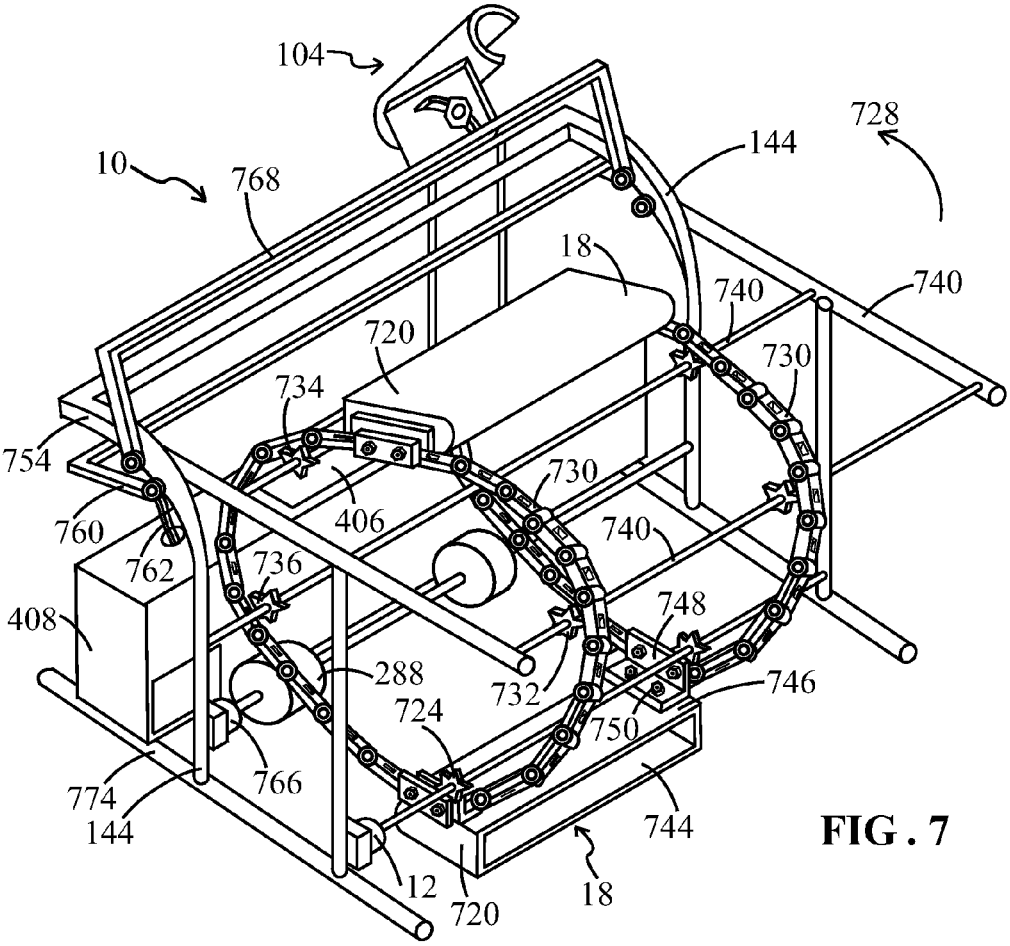
FIG. 7 is a simplified diagram of a fifth preferred embodiment of the invention adapted for use with a pair of endless chains having a power drive driving the chains via cog wheels.

Referring now to FIG. 7 of these drawings for a snow clearing device 10, a fifth preferred embodiment of the invention is shown to be adapted for use with a power drive means, 12, for a continuous rotation of a collector means comprising a plurality of collector elements 18, specifically, an array of u-shaped container-type collector elements 720.

Power drive means 12, mounted on a body frame means 144, drives an array of cog wheels 724 in a counter-clockwise direction as shown by the counter-clockwise directional arrow 728, rotating a transport means defining a continuous conveyor means which comprises a plurality of endless chains 730.

Each endless chain 730 is constrained to move in a closed vertical circuit, having a horizontal axis of rotation and defined by an array of cog wheels 724, 732, 734, 736, supported respectively by their support beams 740 fixedly attached to the body frame means 144. The positions of the cog wheels are such that each of the collector elements 18, moves close enough to the ground being cleared and high enough to deposit snow to the opening 406 of a diverting and processing unit 408 of FIG. 8.

The u-shaped container-type collector elements 720 comprises an opening 744 at one end. The side wall 746 of each of the u-shaped container-type collector elements 720 is mounted on the endless chain 730 by an array of angled brackets 748 using threaded bolts and nuts 750. In the lower portion of the closed vertical circuit adjacent to the surface of the ground, an u-shaped container-type collector element 720 is oriented in a position to the surface of the ground to scoop up the snow on the ground as shown in FIG. 7.

The snow clearing device 10 is mounted on rear wheels 288 for movement during snow clearing. A handle 754 is mounted on the body frame means 144 for steering and controlling the movement of the snow clearing device 10.

A lower pivotable handle 760, having a set of cables 762, activates a power drive means 766 to rotate the rear wheels 288 for the movement of the device 10. An upper pivotable handle 768, when pivoted to engage with the handle 754, activates a diverting and processing unit 408, via the cables 762.

Figure 8:
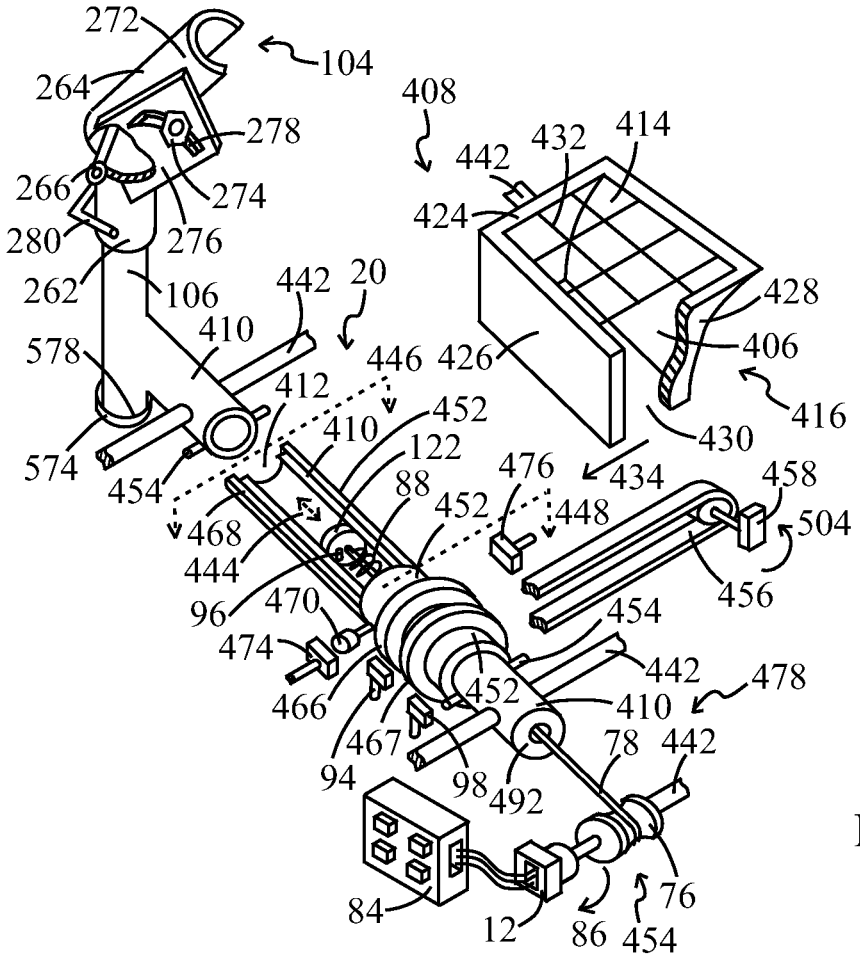
FIG. 8 is a simplified diagram showing a processing unit used in the fifth preferred embodiment of the invention adapted for processing the snow.

The snow collected by a member of the array of collector elements 18 is transported by the continued rotation of endless chains 730 to an elevated portion of the circuit of endless chains 730 for free fall into the opening 406 of the diverting and processing unit 408 of FIG. 8. The diverting and processing unit 408 is mounted on supports 774 attached to the body frame means 144.

Referring now to FIG. 8, FIG. 8 is similar to FIG. 4, except that the snow lifting unit 404 of FIG. 4 is not used in FIG. 8. The operations in the diverting and processing unit 408 in both FIG. 4 and FIG. 8 are identical.

Figure 9:
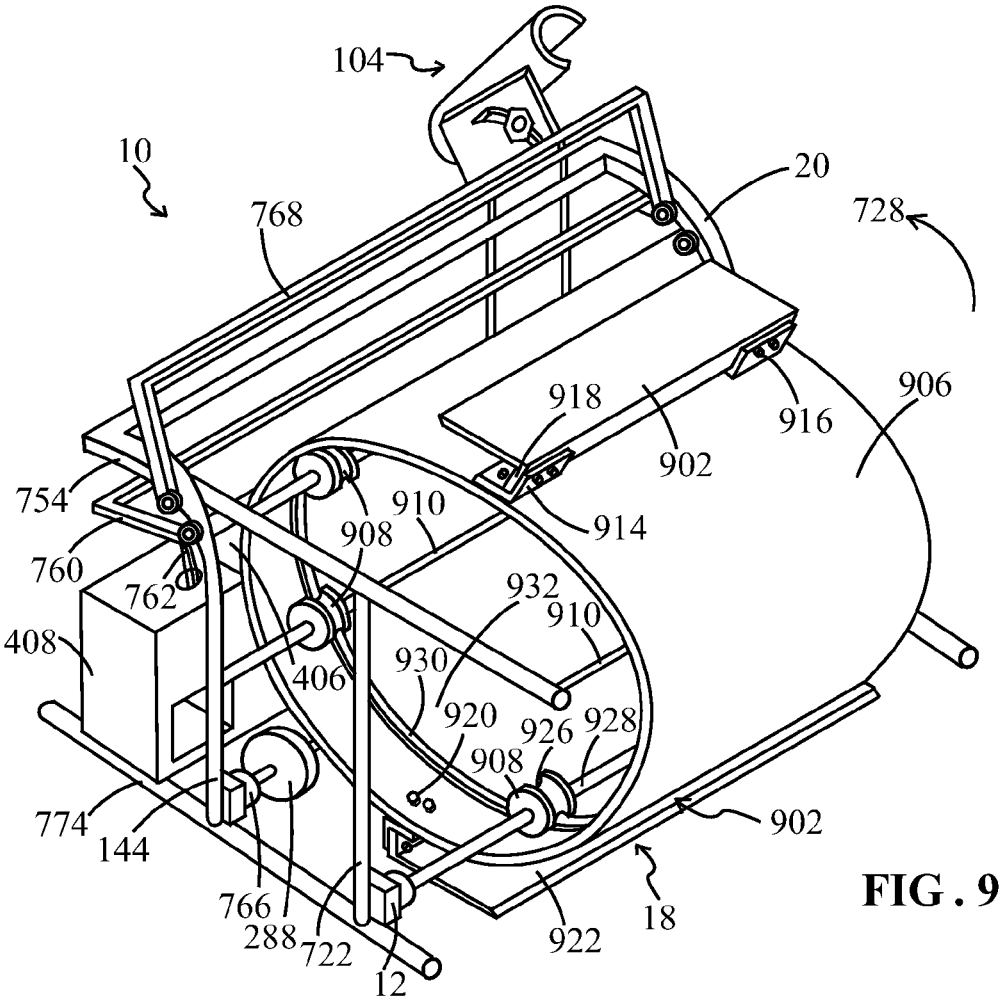
FIG. 9 is a simplified diagram of a sixth preferred embodiment of the invention employing a continuous conveyor belt.

Referring now to FIG. 9 of these drawings, it shows a sixth preferred embodiment of the invention adapted for use with an engine, or the like as a power drive means, 12, for a continuous rotation of a collector means comprising a plurality of collector elements 18, specifically, an array of spade-shaped collector elements 902 for receiving the snow.

A snow clearing device 10 comprises a continuous deformable conveyor belt 906 mounting spade-shaped collector elements 902 which constitute a collector means. Belt 906 is constrained to move in a closed vertical circuit defined by an array of transverse extending rollers 908 supported by support beams 910 fixedly attached to a frame means 144, in a counter-clockwise sense as shown in the drawing by the counter-clockwise directional arrow 728.

Each spade-shaped collector element 902 is mounted to the belt 906 by an array of angled brackets 914 using bolts and nuts 916. The first flat surface of each bracket 914 is mounted to a first end of upper arm 918 of the spade-shaped collector element 902 by the bolts and nuts 916. The second flat surface of the bracket 914 is mounted to the conveyor belt 906 by another array of the bolts and nuts 916 which penetrates corresponding spaced-apart through openings 920 in the conveyor belt 906.

A spade-shaped receiving blade 922, which is mounted orthogonally to a second end of the upper arm 918, is oriented in the direction of the rotation of the belt 906. The power drive means 12 rotates a roller 926 mounted on an axle 928. The roller 926 drives a flexible inner belt 930 which is mounted on the inner surface 932 of the belt 906, causing the belt 906 to rotate in a counter-clockwise direction as shown by the counter-clockwise directional arrow 728. The inner belt 930 can be stapled or threaded to the conveyor belt 906.

The snow collected by a member of the array of collector elements 18 is transported by the continued rotation of endless belt 906 to an elevated portion of the circuit of endless belt 906 for free fall into an opening 406 of the diverting and processing unit 408 of FIG. 8. The diverting and processing unit 408 is mounted on supports 774 attached to the body frame means 144.

Figure 10:
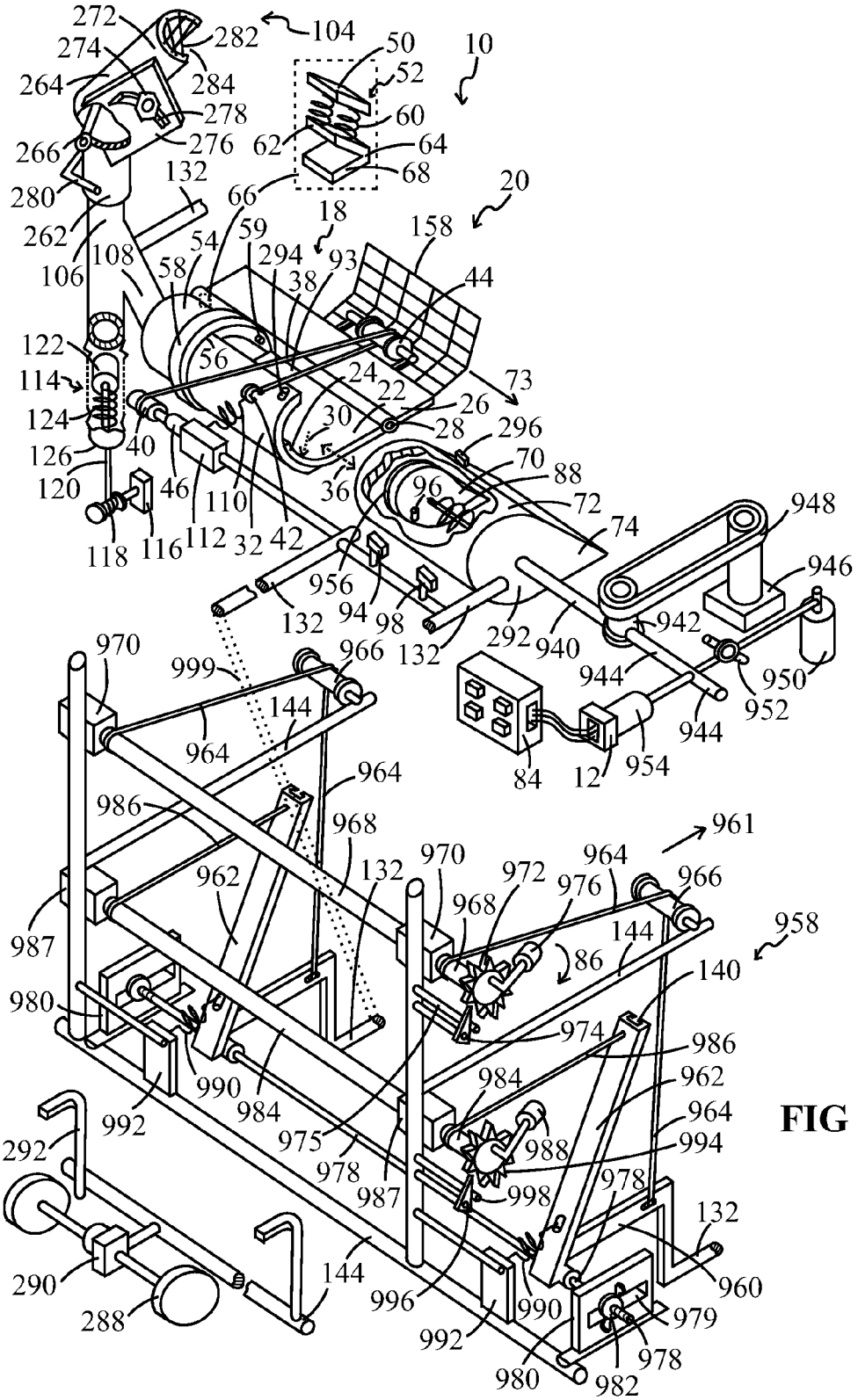
FIG. 10 is a simplified diagram of a seventh preferred embodiment using compressed air as an impacting means to move a piston-like object to eject the snow.

Referring now to FIG. 10 of a snow clearing device 10, a seventh preferred embodiment of the invention is shown for use with an engine, or the like as a power drive means, 12, comprising a spade-shaped collector element 18 for removing the snow.

As shown in FIG. 10, instead of using the spring 88 of FIG. 1, a supply of compressed air is used as a thrust-generating means to exert a strong force to propel the snow 92 residing in the interior of the confined enclosure 90 of FIG. 2 to move out through the vertical pipe 106. The structure and the operation of a snow receiver 20 in this embodiment is similar to the snow receiver 20 of FIG. 1, except that the flexible string 78 of FIG. 1 is replaced by an entry pipe 940.

The entry pipe 940 is connected to the lower bottom cover 74 of the housing 72. An open and shut-off switch 942 is inserted between a tube 944 and the entry pipe 940 to control the flow of the compressed air in the entry pipe 940. The switch 942 is turned on or off by a motor means 946 via a belt 948, in respond to a command issued by a stored program device means 84. The compressed air can be supplied from either a gas bottle 950 through a switch 952 or a compressed air generator 954.

The compressed air, when it is eventually released through the switch 942, flows rapidly into the housing 72. The rapid flow of the compressed air, which generates a strong force in the housing 72, is serving as an energetic means to exert a strong force against the piston-like object 70 to throw the snow out.

A user enters a command to the stored program device means 84 to control the switch 942. The instructions from the stored program means 84 can be issued as an event lasting for a few second at a time during which the compressed air is released and allowed to flow into the entry pipe 940 as a short pulse pushing the snow away.

The instruction can also be set to operate the motor means 946 in a periodic mode in which the compressed air is allowed to flow into the entry pipe 940 periodically in a set amount of time to impact the snow 92 with a strong repetitive force whenever the outer shield 32 and the pivotable flap 26 are rotated to close the exposed opening 93 above the receiving strip 22 of the collector element 18.

A curved thin wall 956 which is protruding out from the outer edge of the piston-like object 70, would help to remove any ice sheets which may form inside the confined enclosure 90 of FIG. 2.

A flexible rubber hose may be used to substitute the entry pipe 940. The chute 104, the hollow enclosure 54, the housing 72 and other associated elements are mounted on an array of inter-connecting support beams 132. The inter-connecting support beams 132 are raised by a manually operated unit 958. An array of T-shaped heads, not shown, is mounted to support arms 960 of the inter-connecting support beams 132.

The following description applies to the structure on the right-hand side of the manually operated unit 958, when the snow clearing device 10 is moving in a forward direction as shown by a directional arrow 961.

A T-shaped head (not shown) on a support arm 960 is slidable inside a T-shaped inner track 140 embedded in a pivotable longitudinal block 962. A flexible string 964, which passes over a relay roller 966, is connected to the support arm 960 and a roller 968. The roller 968 is rotatable and supported by a ball-bearing block 970. A cog wheel 972, which is mounted to the roller 968, is rotatable in a clockwise directional arrow 86.

A pivotable pin 974, which is blocked by a barrier 975, is placed near the cog wheel 972 to prevent the cog wheel 972 from turning in the opposite direction. The roller 968 is rotated by a first handle 976 which is mounted to the cog wheel 972. The roller 968 pulls the string 964 and the inter-connecting support beams 132 is raised from the ground. To release the string 964, the pivotable pin 974 is rotated so that the cog wheel 972 is free to rotate to release the string 964.

The longitudinal block 962, which is pivotable about an axle 978, is movable horizontally through a slot 979 in a support block 980. A portion of the axle 978 is threaded, the axle 978 is fastened by an array of washers and winged nuts 982 to the support block 980.

The longitudinal block 962 is rotatable by rotating a roller 984. A flexible string 986 is connected to the roller 984 and a terminal end of the longitudinal block 962. The roller 984 is supported by a ball-bearing block 987.

When the roller 984 is rotated by a second handle 988, a spring 990 which is positioned between a support 992 and the longitudinal block 962 is compressed. The spring 990 is used to improve the stability of the longitudinal block 962. Similarly, a cog wheel 994 is mounted to the roller 984. A second pivotable pin 996, which is blocked by a barrier 998, prevents the cog wheel 994 from turning in the opposite direction. The second handle 988 is mounted to the cog wheel 994.

The structure and the components, except the handles 976, 988, cog wheels 972, 994 and their associated members, are similarly duplicated on the left-hand side of the manually operated unit 958. The manually operated unit 958 in FIG. 10 has been scaled up disproportionally in order to show a clear picture of the structure of the manually operated unit 958.

A one of the interconnecting support beams 132 extending from the support board 112 is connected to the interconnecting support beams 132 of the manually operated unit 958 as shown by a pair of dashed line 999.

It is noted that a properly designed curved inner shield may replace the curved inner sheet 24 and the pivotable flap 26. The shape of the outer shield 32 may be adjusted properly to close the exposed opening 93 when rotated. The spring 88, the piston-like object 70 of FIG. 10 and the piston 122 of FIG. 4 may not be required if a full load of the snow is expected to completely fill the interior of the confined enclosure 90 of FIG. 2. However, due to the recurring icing condition in the enclosure, a helical spring and a slidable object with a protruding curved thin wall 956 mounted on its forwarding front edge are preferred to be installed in the snow clearing device.

It is noted that the structures described above are configured in a simplified form, additional support means may be needed to provide better stability to the structures disclosed above.

Having described the invention and its preferred mode of operation in sufficient detail for those of normal skill in the art to practice the same, it will be obvious to such practitioners to make certain changes and variations in the specific elements of the disclosed embodiments without departing from the scope of the invention. For these reasons, the scope of the invention should not be limited by that which has been illustrated herein but should be limited only by the scope of the appended claims:

What is claimed is:

1. A device for removing snow from the ground, in combination with a wheeled means defining a frame, comprising:

a) receiver means defining an enclosure comprising an opening for receiving said snow;

b) shutter means comprising a plurality of retractable shields for closing said opening in said receiver means to form a confined enclosure;

c) impacting means comprising a slidable object which slides in said confined enclosure to make an impact at said snow and to move said snow away;

d) energizer means comprising a generator for use to energize said slidable object; and e) drive means comprising a power drive for the control of said shutter means;

said opening is closed by said retractable shields after said snow is deposited into said confined enclosure through said opening; said impacting means, having been energized by said energizer means, is released for sliding movement in said confined enclosure; said impacting means makes an impact at said snow; said snow is forced to move in said confined enclosure; said snow is ejected through an outlet at a distal end of said confined enclosure.

2. The device of claim 1, wherein said energizer means comprises a helical spring which is compressed when said slidable object is moved toward a distal end of said confined enclosure; said helical spring transfers an impacting energy generated in a deformed state to said slidable object.

3. The device of claim 1, wherein said generator is a compressed air generator for supplying compressed air that flows rapidly into said confined enclosure to empower said slidable object to slide in said confined enclosure.

4. The device of claim 1, wherein said device comprises a transport means to lift said receiver means to a different height from the ground for clearing the snow.

5. The device of claim 1, wherein said device comprises a snow lifting unit which collects and transports said snow higher above the ground for free fall into said receiver means.

6. The device of claim 5, wherein said snow lifting unit defines a continuous conveyor means, mounting a plurality of collector elements adapted to elevate and transport said snow, moving in a closed vertical circuit, and having a horizontal axis of rotation.

7. The device of claim 6, wherein said conveyor means comprises a plurality of endless chains.

8. The device of claim 6, wherein said conveyor means comprises a continuous belt.

9. The device of claim 1, wherein said generator defining a manually driven generator in which a handle is used to rotate a roller; said roller is rotated to cause a helical spring to be deformed; said helical spring in a deformed state conveys an impacting energy deliverable to said impacting means when said helical spring is allowed to return to its normal state.

10. The device of claim 1, wherein said device includes a plurality of sensors for use with a stored program device means.

11. The device of claim 1, wherein said device comprises a thin wall protruding out from the outer edge of said slidable object to remove any ice sheet formed within said confined enclosure.

12. A device for removing snow from the ground, in combination with a wheeled means defining a frame, comprising:

a) receiver means defining an enclosure comprising an opening for receiving said snow;

b) shutter means comprising a plurality of retractable shields for closing said opening in said receiver means to form a confined enclosure;

c) impacting means comprising a slidable object which slides in said confined enclosure to make an impact at said snow and to move said snow away;

d) energizer means comprising a helical spring to energize said slidable object; and e) drive means comprising a power drive for the control of said shutter means;

said opening is closed by said retractable shields after said snow is deposited into said confined enclosure through said opening; said helical spring is compressed in a deformed state to produce an impacting energy which is delivered to said impacting means; said impacting means is released for sliding movement in said confined enclosure; said impacting means makes an impact at said snow; said snow is forced to move in said confined enclosure; said snow is ejected through an outlet at a distal end of said confined enclosure.

13. The device of claim 12, wherein said device comprises a transport means to lift said receiver means to a different height from the ground for clearing the snow.

14. The device of claim 12, wherein said device comprises a snow lifting unit which collects and transports said snow higher above the ground for free fall into said receiver means.

15. The device of claim 12, wherein said device comprises a thin wall protruding out from the outer edge of said slidable object to remove any ice sheet formed within said confined enclosure.

16. A device for removing snow from the ground, in combination with a wheeled means defining a frame, comprising:

a) receiver means defining an enclosure comprising an opening for receiving said snow;

b) shutter means comprising a plurality of retractable shields for closing said opening in said receiver means to form a confined enclosure;

c) impacting means comprising a slidable object which slides in said confined enclosure to make an impact at said snow and to move said snow away;

d) energizer means comprising a compressed air generator to energize said slidable object; said compressed air generator is to supply compressed air which exerts a strong force against said slidable object for moving said slidable object; and e) drive means comprising a power drive for the control of said shutter means;

said opening is closed by said retractable shields after said snow is deposited into said confined enclosure through said opening; said compressed air is in a compressed state in said confined enclosure to produce an impacting energy to said impacting means; said impacting means is forced to slide in said confined enclosure to eject said snow through an outlet at a distal end of said confined enclosure.

17. The device of claim 16, wherein said device comprises a transport means to lift said receiver means to a different height from the ground for clearing the snow.

18. The device of claim 16, wherein said device comprises a snow lifting unit which collects and transports said snow higher above the ground for free fall into said receiver means.

19. The device of claim 16, wherein said device includes a plurality of sensors for use with a stored program device means.

20. The device of claim 16, wherein said device comprises a thin wall protruding out from the outer edge of said slidable object to remove any ice sheet formed within said confined enclosure.

* * * * *